United States Patent [19]

Roman et al.

[11] Patent Number: 4,867,222

[45] Date of Patent: Sep. 19, 1989

[54] HANG UPS

[76] Inventors: Jose Roman, 12 Fayette St., Brooklyn, N.Y. 11206; George Spector, 233 Broadway Rm 3815, New York, N.Y. 10007

[21] Appl. No.: 207,494

[22] Filed: Jun. 16, 1988

[51] Int. Cl.[4] ..... E06B 3/00

[52] U.S. Cl. ..... 160/89; 160/354; 160/368.1

[58] Field of Search ..... 160/368.1, 354, 327, 160/89

[56] References Cited

U.S. PATENT DOCUMENTS 4,249,589 2/1981 Loeb ..... 160/368.1

FOREIGN PATENT DOCUMENTS 2477214 9/1981 France ..... 160/354

*Primary Examiner*—Blair M. Johnson

[57] ABSTRACT

A screen and storm window cover is provided which is readily attachable to and removable from a window frame and consists of a screen panel attached to hook fabric fastener strips on the window frame for summer conditions. A transparent plastic sheet with loop fabric fastener strips about its perimeter can interlock through the screen panel to the hook fabric fastener strips for winter conditions.

1 Claim, 1 Drawing Sheet

HANG UPS

BACKGROUND OF THE INVENTION

The instant invention relates generally to window covering devices and more specifically it relates to a screen and storm window cover.

Numerous window covering devices have been provided in prior art that are adapted to be removably mounted to existing windows to act as screen or storm windows. For example, U.S. Pat. Nos. 3,251,399: 4,068,428 and 4,249,589 are all illustrative of such prior art. While these units may be suitable for the particular purpose to which they address, they would not be as suitable for the purpose of the present invention as heretofore described.

SUMMARY OF THE INVENTION

A primary object of the present invention is to provide a screen and storm window cover that will overcome the shortcomings of the prior art devices.

Another object is to provide a screen and storm window cover that can be removably attached to a window frame to make a weather-tight closure for winter and summer conditions.

An additional object is to provide a screen and storm window cover that when removed from the window frame can be rolled up quickly for storage.

A further object is to provide a screen and storm window cover that is simple and easy to use.

A still further object is to provide a screen and storm window cover that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 3:
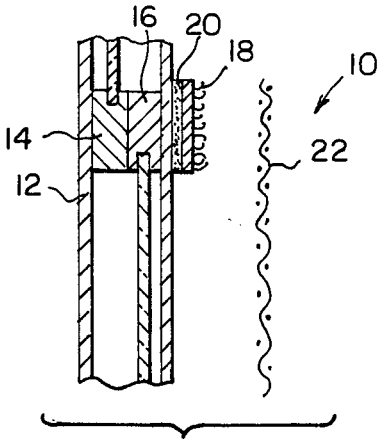
FIG. 3 is an enlarged cross sectional view partly exploded similar to FIG. 2 showing screen panel without the plastic sheet so as to be used for summer conditions.

Turning now descriptively to the drawings, in which similar reference characters denote similar elements throughout the several views, FIG. 3 illustrates a window cover 10 that is readily attachable to and removable from a window frame 12 with window sashes 14 and 16. The cover 10 consists of a plurality of elongated hook fabric fastener strips 18 secured about perimeter of the window frame 12 by adhesive 20. A screen panel 22 is mounted at its margin onto the hook fabric fastener strips 18 to cover the window sashes 14 and 16, to be used during summer conditions. The hook fastener strip 18 interlock sufficiently with the screen material to retain the screen thereon or other conventional means may be used to retain the screen on the window frame.

Figure 1:
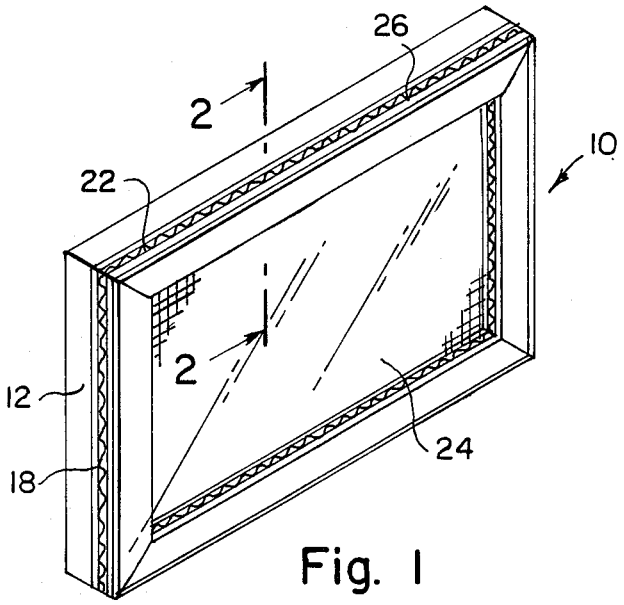
FIG. 1 is a perspective view of the invention mounted on a window frame.
Figure 2:
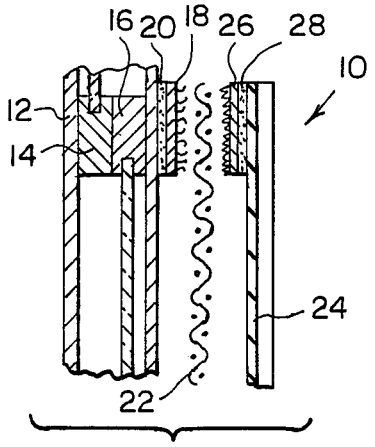
FIG. 2 is an enlarged cross sectional view partly exploded and taken along line 2—2 in FIG. 1.

FIGS. 1 and 2 show a flexible sheet 24 of transparent plastic material and a plurality of elongated loop fabric fastener strips 26 secured about perimeter of the sheet 24 by adhesive 28. On positioning the sheet 24 with the loop fabric fastener strips 26 towards the screen panel 22 and applying pressure thereon the hook and loop fabric fastener strips will interlock through the margin of the screen panel 22 to secure the sheet 24 in a fixed position with respect to the window frame 12 and covering the window sashes 14 and 16 so as to act as weather stripping to be used during winter conditions.

Figure 4:
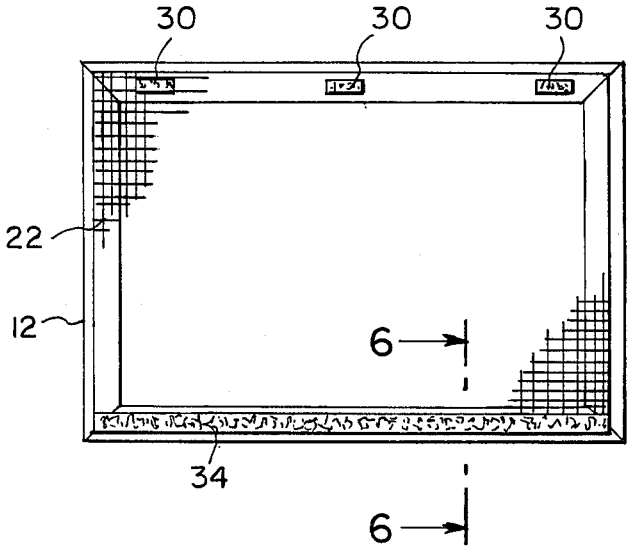
FIG. 4 is a front view of a modification in which the screen panel has hook fabric fastener tabs along top outer margin and a loop fabric fastener strip bent over along bottom margin thereof.
Figure 5:
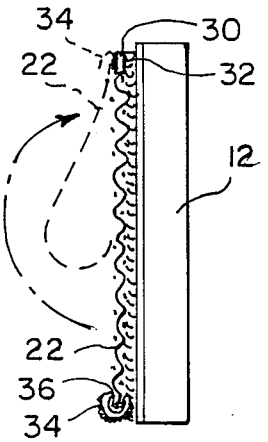
FIG. 5 is a side view of FIG. 4 showing in phantom the screen panel in a fold up position so as to have access to the window.
Figure 6:
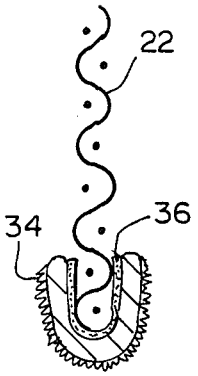
FIG. 6 is an enlarged cross sectional view taken along line 6—6 in FIG. 4 showing the bent over loop fabric fastener strip in greater detail.

FIGS. 4 and 5 show the screen panel 22 with a plurality of hook fabric fastener tabs 30 secured along top outer margin by adhesive 32. A loop fabric fastener strip 34, best seen in FIG. 6, is bent over and secured along bottom margin thereof by adhesive 36. When the screen panel 22 is in a fold up position, as shown in phantom in FIG. 5, the bent over loop fabric fastener strip 34 will interlock with the hook fabric fastener tabs 30 when pressure is applied thereto allowing a person (not shown) to obtain access to the window sashes 14 and 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A window cover readily attachable to and removable from a window frame having a window sash, said cover comprising:

(a) a plurality of elongated hook fabric fastener strips to be secured about the perimeter of the window frame and (b) a removable flexible, woven screen panel mounted at its perimeter directly onto said hook fabric fastener strips to be used during summer conditions; said panel being maintained on said strips solely by interlocking engagement between the screen panel and said strips;

(c) in combination with a transparent sheet of insulating material spaced from said screen panel; further including a plurality of elongated loop fastener strips secured about the perimeter of said sheet, whereby on positioning said sheet with said loop fabric fastener strips towards said screen panel and applying pressure thereon said hook and loop fabric fastener strips will interlock through the perimeter of said screen panel to secure said sheet in a fixed position with respect to the window frame and covering the window sash so as to act as a weather stripping to be used in winter conditions.

* * * * *